US005816571A

United States Patent [19]

Chen

[11] Patent Number: 5,816,571

[45] Date of Patent: Oct. 6, 1998

[54] SPHERICAL PUZZLE TOY

[76] Inventor: Tsun Ding Chen, P.O. Box 82-144, Taipei, Taiwan

[21] Appl. No.: 889,844

[22] Filed: Jul. 8, 1997

[51] Int. Cl.[6] ..... A63F 9/08

[52] U.S. Cl. ..... 273/153 S

[58] Field of Search ..... 273/153 R, 153 S, 273/155

[56] References Cited

U.S. PATENT DOCUMENTS

| | | | |
|---|---|---|---|
| 4,452,454 | 6/1984 | Greene | 273/153 S |
| 5,215,305 | 6/1993 | Hsun | 273/153 S |
| 5,333,869 | 8/1994 | Hsun | 273/153 S |
| 5,389,063 | 2/1995 | Wu | 273/153 S |
| 5,575,476 | 11/1996 | Yang | 273/153 S |

FOREIGN PATENT DOCUMENTS

| | | | |
|---|---|---|---|
| 512928 | 11/1992 | European Pat. Off. | 273/153 S |

*Primary Examiner*—Steven B. Wong
*Attorney, Agent, or Firm*—A & J

[57] ABSTRACT

A spherical puzzle toy includes a spherical shell having six circular recesses disposed on X-axis, Y-axis and Z-axis at two opposite sides, six circular turn plates respectively turnably mounted on the circular recesses and having each a respective crossed track on the outside linked with one another, and a plurality of slides moved in the crossed tracks to form any of a variety of combinations.

1 Claim, 4 Drawing Sheets

SPHERICAL PUZZLE TOY

BACKGROUND OF THE INVENTION

1. Field of the Invention

This invention relates to puzzle toys, and relates more particularly to a puzzle ball having interconnected sliding ways, that can be switched on the axes X, Y and Z, and slides moved in the sliding ways and arranged by the player into any of a variety of combinations.

2. Description of the Prior Art

Various puzzle toys including triangular puzzle blocks, square puzzle blocks, cylindrical puzzle blocks, etc., are well known. These puzzle toys are commonly handy and can be arranged into any of a variety of combinations.

There is also known a spherical puzzle toy comprised of a rotary base and six individual rotary members respectively mounted on the rotary base, each individual rotary member having a plurality of notches around the border, and a plurality of slides respectively disposed in the notches among the rotary members. By turning the individual rotary members, the slides are respectively moved from one notch to another. This structure of spherical puzzle toy is less attractive because it produces little variation and, the slides can be easily moved from one notch to another to set the desired combination.

SUMMARY OF THE INVENTION

This invention relates to puzzle toys, and relates more particularly to a puzzle ball having interconnected sliding ways, that can be switched on the axes X, Y and Z, and slides moved in the sliding ways and arranged by the player into any of a variety of combinations.

According to one aspect of the present invention, the spherical puzzle toy comprises a spherical shell having six circular recesses disposed on X-axis, Y-axis and Z-axis at two opposite sides, six circular turn plates respectively turnably mounted on the circular recesses and having each a respective crossed track on the outside linked with one another, and a plurality of slides moved in the crossed tracks to form any of a variety of combinations. The turn plates can be turned step by step through 90 degrees per step to change the connection of the crossed tracks of the turn plates.

DETAILED DESCRIPTION OF THE PREFERRED EMBODIMENT

Figure 1:
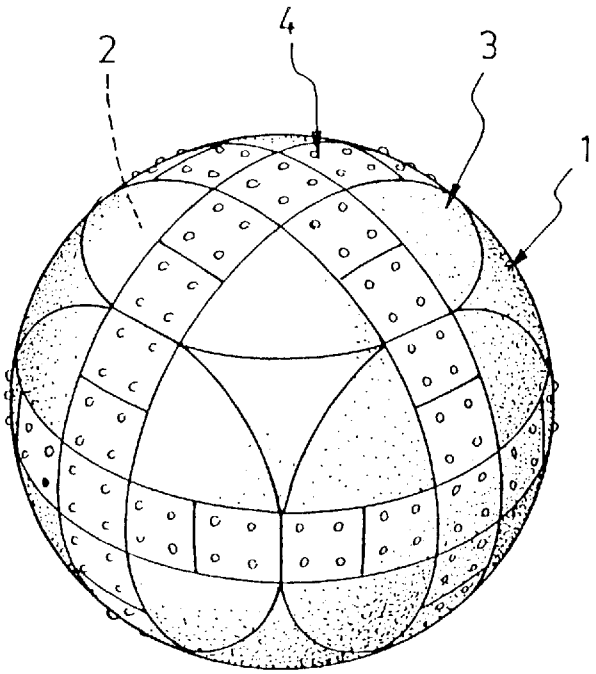
FIG. 1 is an elevational view of a spherical puzzle toy according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
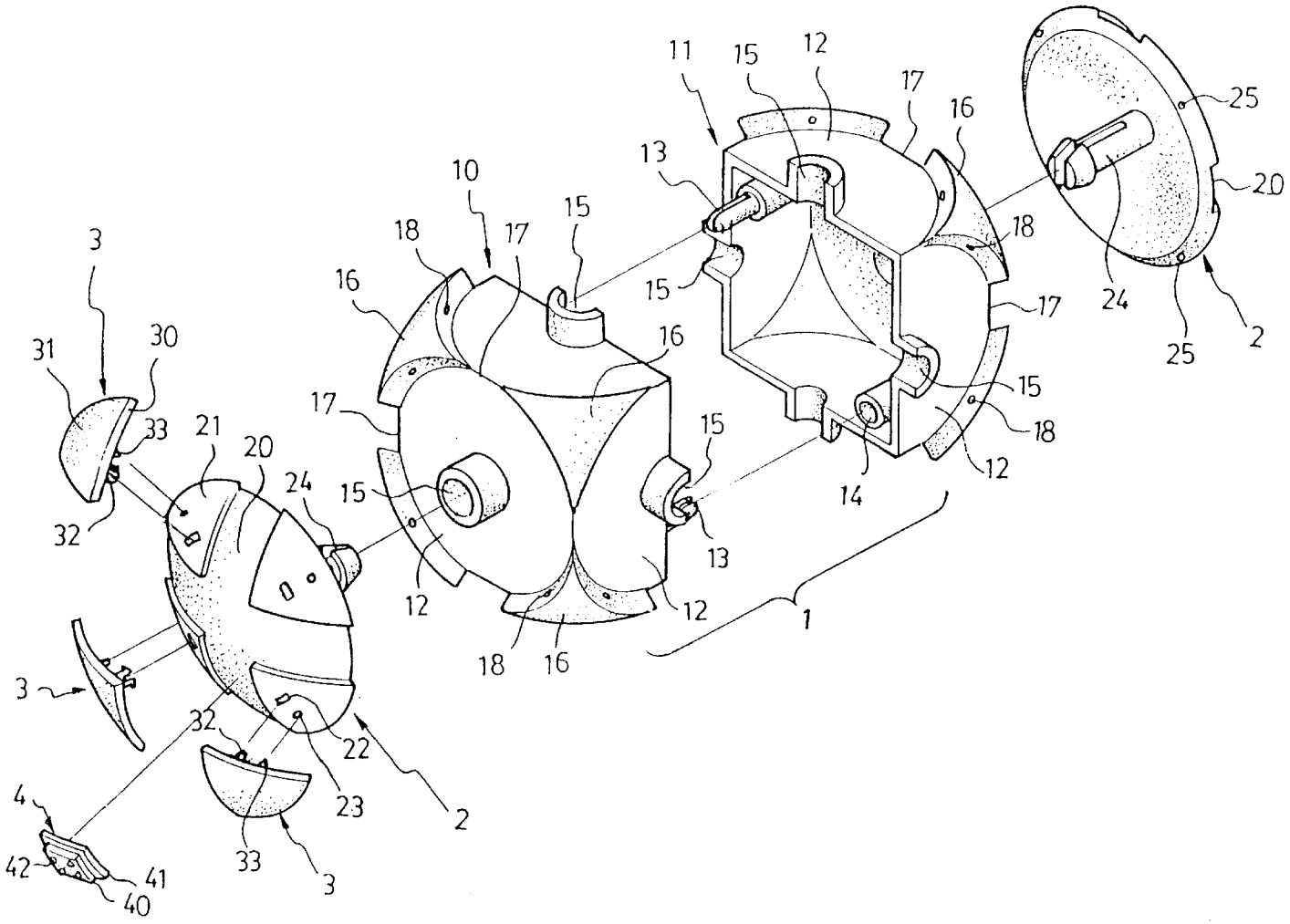
FIG. 2 is an exploded view of the spherical puzzle toy shown in FIG. 1.

Referring to FIGS. 1 and 2, a spherical puzzle toy in accordance with the present invention is generally comprised of a substantially spherical shell 1, a plurality of turn plates 2, a plurality of track guards 3, and a plurality of slides 4. Turn plates 2 are turnably mounted around the spherical shell 1. Track guards 3 are respectively mounted on each turn plate 2 defining a crossed track 20 on each turn plate 2. Slides 20 are moved from the crossed track 20 on one turn plate 2 to another along X-axis, Y-axis and Z-axis.

Figure 3:
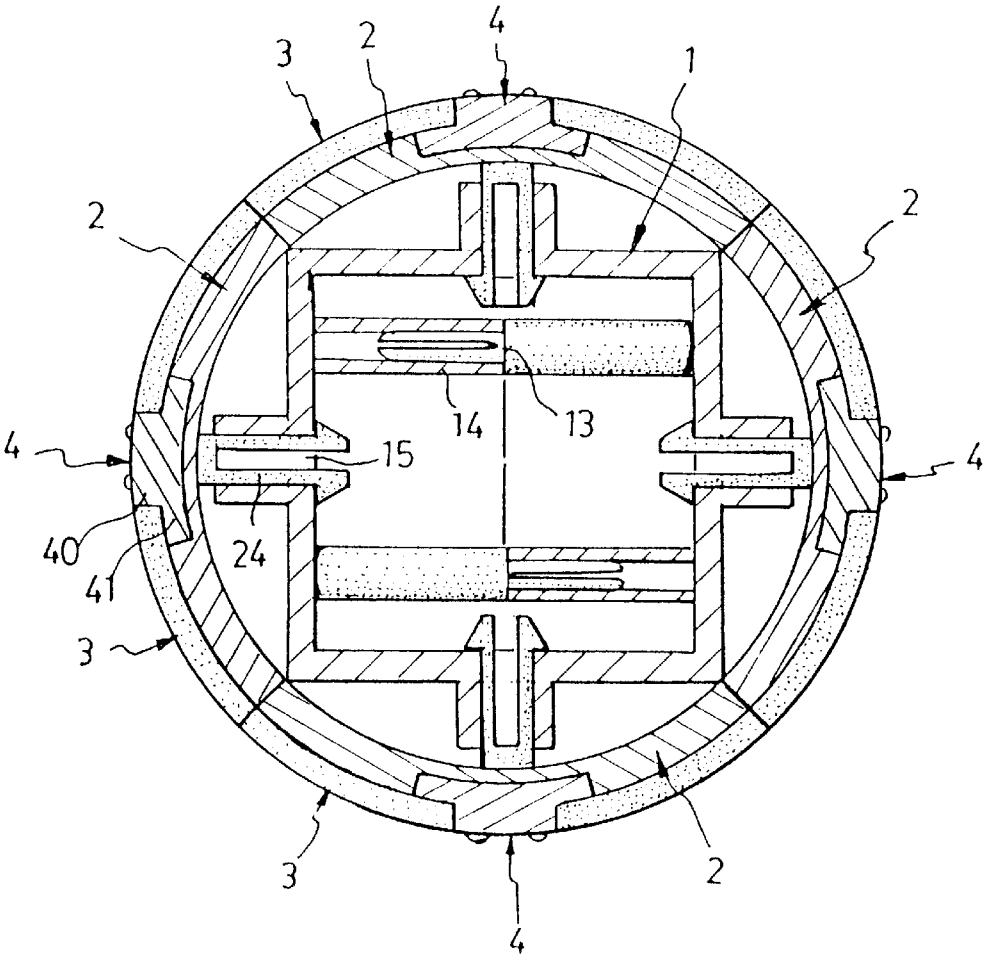
FIG. 3 is a cross section of the spherical puzzle toy shown in FIG. 1.

Referring to FIGS. 2 and 3 again, the aforesaid shell 1 is comprised of two symmetrical halves, namely, the left half shell 10 and the right half shell 11 connected together by fitting the split pins 13 on either half shell into the pin holes 14 on the other half shell. The spherical shell 1 comprises six circular recesses 12 respectively disposed at two opposite sides of the X-axis, Y-axis and Z-axis, eight raised blocks 16 of substantially triangular shape respectively disposed around either circular recess 11, a plurality of passages 17 respectively disposed between each two circular recesses 12 to separate the raised blocks 16 from one another and a plurality of axle holes 15 respectively disposed at the center of each circular recess 11. Six turn plates 2 are respectively turnably mounted within each circular recess 12, each having a downward split bolt 24 at the bottom respectively inserted into the axle hole 15 on either circular recess 12 and four raised blocks 21 of substantially triangular shape and a crossed track 20 defined by the raised blocks 21. Each raised block 21 has a retaining hole 22 and a locating hole 23. There are total twenty four track guards 3 respectively mounted on raised blocks 21 and disposed in flush with the raised blocks 16. Each track guard 3 has a downward retaining rod 32 and a downward locating pin 33 respectively fitted into the retaining hole 22 and locating holes 23 on either raised block 21, a peripheral flange 30 projecting into the crossed track 20 on the respective turn plate 2, and a top surface 31 disposed in flush with the adjacent raised block 16. The aforesaid slides 4 are moved in the crossed tracks 20 of the turn plates 2 in the X, Y and Z directions. Each slide 4 comprises a bottom plate 41 at the bottom in width equal to that of the crossed tracks 20 and the passages 17, and a top plate 40 raised from the bottom plate and supported between the side flanges 30 of two adjacent track guards 3 on either turn plate 2. The top plate 40 of each slide 4 has a coarse top surface 42 so that it can be positively moved by the fingers and, it massages the fingers when moved. When the spherical puzzle toy is assembled, the track guards 3, the raised blocks 16 of the spherical shell 1, and the top plates 40 of the slides 4 form a sphere, and the crossed tracks 20 (the slides 4) are linked in the X-axis, Y-axis and Z-axis. Each circular turn plate 2 further comprises four raised portions 25 equiangularly spaced around the border respectively alternatively engaging respective recessed portions 18 around the peripheral wall of each circular recess 12. Therefore the circular turn plates 2 can be respectively turned relative to one another and then alternatively positioned at every 90 degrees to keep the crossed tracks 20 of the circular turn plates 2 interconnected.

Figure 4:
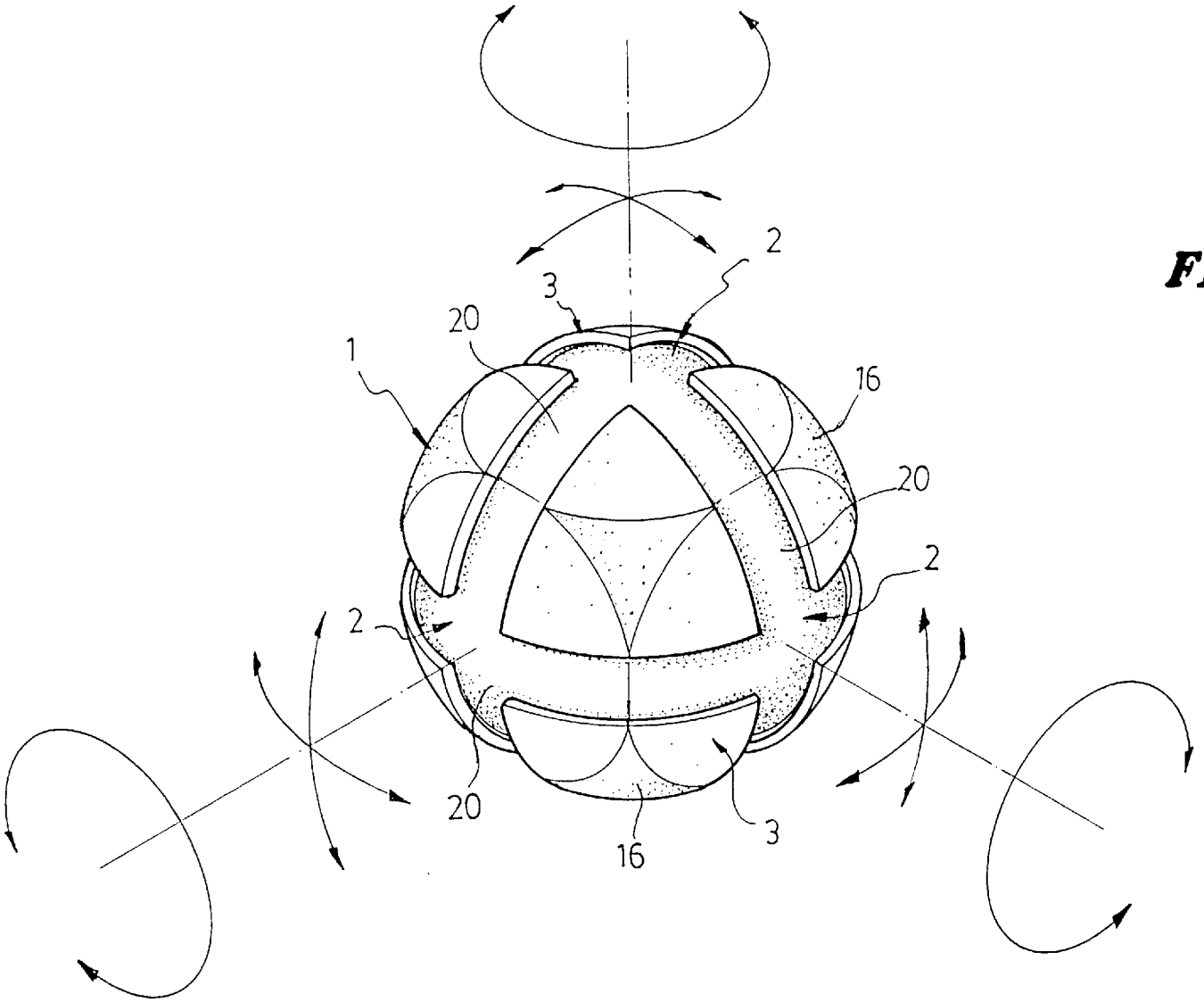
FIG. 4 shows the circular turn plates of the spherical toy of FIG. 1 respectively turned.

As indicated in FIG. 4, the circular turn plates 2 can be turned on the spherical shell 1 relative to one another through 360 degrees so that the slides 4 in the crossed tracks 20 can be shifted among axes X, Y and Z.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A spherical puzzle toy comprising:

a spherical shell having six circular recesses respectively disposed on X-axis, Y-axis and Z-axis at two opposite sides and linked with one another, each circular recess having a respective axle hole at the center and a vertical peripheral wall and four recessed portions equiangularly spaced around the vertical peripheral wall;

six circular turn plates respectively mounted on said circular recesses, having each a respective bottom split bolt respectively turnably inserted into the axle holes of said recesses and a crossed track on the outside linked with one another, each circular turn plate having four raised portions equiangularly spaced around the border and alternatively engaged with the recessed portions on each circular recess;

a plurality of substantially triangular track guards respectively mounted on said circular turn plates around the crossed tracks, each triangular track guard having a peripheral flange respectively projecting into the crossed tracks of said circular turn plates;

a plurality of slides moved in the crossed tracks of said circular turn plates, each slide having a bottom plate moved in the crossed tracks of said circular turn plates and a top plate raised from the bottom plate at the top and respectively movably stopped between the peripheral flanges of each two adjacent track guards, the top plate of each slide having a top wall made with a plurality of raised portions and recessed portions.

* * * * *